US005544393A

United States Patent [19]

Lightfoot

[11] Patent Number: 5,544,393

[45] Date of Patent: Aug. 13, 1996

[54] DRAPERY CLIP

[75] Inventor: Jerry J. Lightfoot, Frisco, Tex.

[73] Assignee: Display Products, Inc., Dallas, Tex.

[21] Appl. No.: 492,669

[22] Filed: Jun. 20, 1995

[51] Int. Cl.[6] ..... A47H 1/00

[52] U.S. Cl. ..... 24/306; 24/716; 248/911; 248/912; 160/330

[58] Field of Search ..... 24/306, 716, 457, 24/562, 555, 545; 160/330, 341, 348; 248/911, 912, 914

[56] References Cited

U.S. PATENT DOCUMENTS

| | | | |
|---|---|---|---|
| Re. 29,979 | 5/1979 | Guebert et al. | 160/330 |
| 2,516,760 | 7/1950 | Doran | 248/914 X |
| 2,973,176 | 2/1961 | Malafouris | 160/330 |
| 3,018,774 | 1/1962 | Rubens | 160/330 X |
| 3,368,601 | 2/1968 | Gantert-Merz | 160/330 X |
| 3,905,414 | 9/1975 | Guebert et al. | 160/330 |
| 4,153,097 | 5/1979 | Pettibone | 160/330 |
| 4,213,492 | 7/1980 | Guebert et al. | 160/124 |
| 4,237,958 | 12/1980 | Guebert et al. | 160/330 |
| 5,060,712 | 10/1991 | Ehrlich | 160/330 |
| 5,090,095 | 2/1992 | Lightfoot | 24/306 |

*Primary Examiner*—Peter M. Cuomo
*Assistant Examiner*—Robert J. Sandy
*Attorney, Agent, or Firm*—Ross, Clapp, Korn & Montgomery, L.L.P.

[57] ABSTRACT

A clip for alternatively draping one of two structures, the first structure having a top surface, an underside surface, and a peripheral edge; the second structure having a rod support member, includes a face portion having front and back surfaces. The back surface contacts the peripheral edge of the first structure. A first leg is perpendicularly disposed to and extends rearwardly from the back surface. The first leg contacts the top surface of the first structure. A slide member is disposed adjacent the back surface and is movable between the first and second ends of the face portion. The slide member includes a linear portion for engaging the underside surface of the first structure of various sized peripheral edges. The slide member includes a plurality of fasteners. The clip includes a second leg having a curvilinear portion that extends rearwardly from the back surface of the face portion for engaging the rod support member. The curvilinear portion has first and second ends. The first end is connected to the back surface of the face portion. The second end of the curvilinear portion is selectively received by one of the plurality of fasteners on the slide member for selectively connecting the second leg to the slide member. A fastener is attached to the face portion for detachably mating with fasteners on the drape.

12 Claims, 2 Drawing Sheets

DRAPERY CLIP

TECHNICAL FIELD OF THE INVENTION

This invention relates to attachment devices, and more particularly to drapery and decorative skirt connector clips and support systems for removably attaching flexible fabrics such as, for example, skirts and drapes to support structures.

BACKGROUND OF THE INVENTION

On many occasions, hotels, restaurants, convention centers, and other institutions often require that tables, temporary stages, elevated platforms, and area dividers include some type of drapery or skirting. This skirting is normally secured or coupled in some manner to the top of tables, platforms or drapery rods and hangs therefrom. The skirting ordinarily hangs from the surface of the table to a location adjacent the floor to create a pleasing decorative effect. Additionally, drapery systems are utilized for providing partitions to which signs and custom drapes are affixed in order to partition and divide areas between exhibitors at convention centers.

Various types of apparatus and techniques have been previously employed to secure or attach drapery and skirting. Such apparatus is described in, for example, U.S. Pat. Nos. 3,905,414; 4,153,097; 4,213,492; 4,237,958; and 5,090,095. Other techniques commonly employed to secure a skirt to a table are to directly tack, staple or pin the skirting to the table or platform. This technique, however, results in damage to the drapery and the surface to which it is stapled. Further, such techniques are inconvenient and time consuming for applying, removing and interchanging the skirt. Furthermore, many platform stages or tables commonly employ metallic surfaces to which the drape cannot be stapled.

Prior skirting support systems which utilize clips to fasten the skirt to an edge of a table suffer from the disadvantage in that the clips must accommodate various thicknesses of table edges to which a drape may be attached. Furthermore, many tables utilize a downwardly extending flange around the periphery of a table which necessitates a customized clip for mounting a skirt to a table. Additional connector clips are required for attaching drapery to a cylindrical support rod which is used for partitions between exhibitors at convention centers. Therefore, a variety of drapery clips are required to be maintained in inventory to satisfy the needs of various users of drape and skirting systems.

Therefore, a need has arisen for a drapery clip to accommodate various thicknesses of table edges, tables having downwardly extending flanges, as well as for use with drapery rods.

SUMMARY OF THE INVENTION

In accordance with the present invention, a clip for alternatively draping one of two structures, the first structure having a top surface, an underside surface, and a peripheral edge; the second structure having a rod support member is provided. The clip includes a face portion having front and back surfaces. The back surface contacts the peripheral edge of the first structure. A first leg is perpendicularly disposed to and extends rearwardly from the back surface. The first leg contacts the top surface of the first structure. A slide member is disposed adjacent the back surface and is movable between the first and second ends of the face portion. The slide member includes a linear portion for engaging the underside surface of the first structure of various sized peripheral edges. The slide member includes a plurality of fasteners. The clip includes a second leg having a curvilinear portion. The curvilinear portion extends rearwardly from the back surface of the face portion for engaging the rod support member of the second structure. The curvilinear portion has first and second ends. The first end is connected to the back surface of the face portion and the second end is spaced apart from the back surface of the face portion. The second end of the curvilinear portion is selectively received by one of the plurality of fasteners on the slide member for selectively connecting the second leg to the slide member. A fastener is attached to the face portion for detachably mating with fasteners on the drape.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
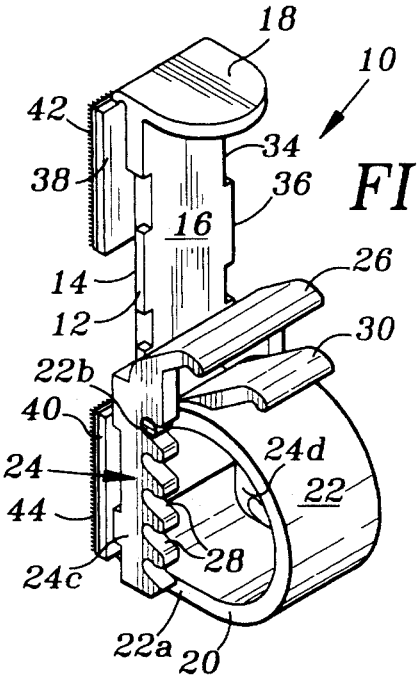
FIG. 1 is a rear perspective view illustrating the present drapery clip.
Figure 2:
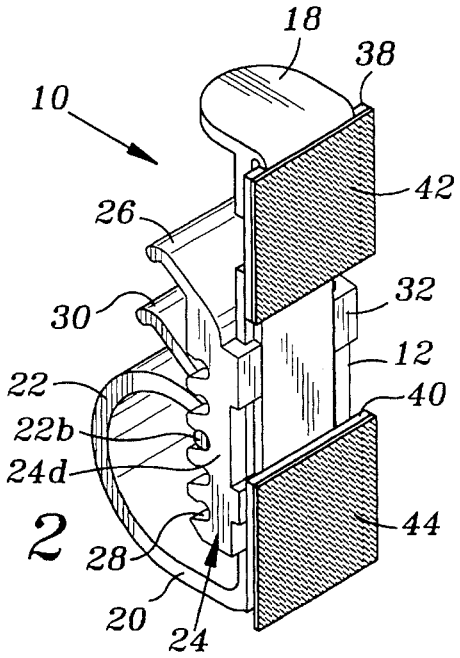
FIG. 2 is a front perspective view illustrating the present drapery clip.
Figure 3:
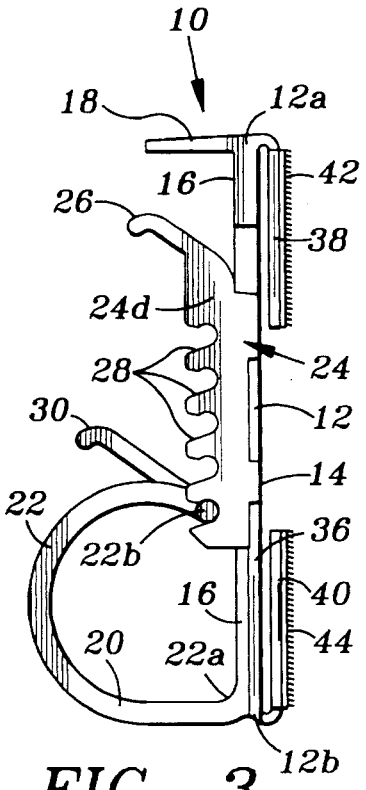
FIG. 3 is a side elevational view of the present drapery clip.

Referring to FIGS. 1–3, the present drapery clip for attaching a drape or skirt to a structure is illustrated, and is generally identified by the numeral 10. Drapery clip 10 may be utilized, for example, for attaching a drape to various types of tables, platforms, or drapery rods. As used herein, the term "drape" generally means, and is intended to include, any type of skirting, curtains, trimmings or the like formed of any type of material or fabric used for decorating or enhancing the appearance of an item to which it is coupled. Additionally, the term "drape" may refer to a sign or other display which is detachably coupled to a support rod or curtain. The term "rod" refers to a drapery support that has, for example, a circular or square shape.

Clip 10 includes a face portion 12 having ends 12*a* and 12*b*. Face portion 12 includes a front surface 14 and a back surface 16. A leg 18 is perpendicularly disposed to face portion 12, and extends rearwardly from back surface 16 of face portion 12 at end 12*a*. Clip 10 further includes a leg 20 having a curvilinear portion 22 having ends 22*a* and 22*b*. End 22*a* of curvilinear portion 22 extends tangentially from end 12*b* of face portion 12 and rearwardly therefrom. End 22*b* of curvilinear portion 22 is spaced apart from back surface 16 of face portion 12.

Referring to FIGS. 1–3 and 7, the present drapery clip 10 includes a slide member, generally identified by the numeral 24. Slide member 24 includes ends 24*a* and 24*b*. Disposed adjacent end 24*a* of slide member 24 is a leg 26 extending rearwardly. Slide member 24 further includes side walls 24*c* and 24*d*. Side walls 24*c* and 24*d* include a plurality of slots 28 which selectively receive end 22*b* of curvilinear portion 22 of leg 20. Slide member 24 is slidably engaged by face portion 12 of drapery clip 10 to slide between ends 12*a* and 12*b* of face portion 12. FIG. 1 illustrates slide member 24 in its lowermost position such that end 22*b* of curvilinear portion 22 engages the topmost slot 28 in side walls 24*c* and 24*d* of slide member 24. FIG. 3 illustrates slide member 24 in its uppermost position such that end 22*b* of curvilinear portion 22 engages the lowermost slot 28 of side walls 24*c* and 24*d* of slide member 24. The movement of slide member 24 between ends 12*a* and 12*b* of face portion 12 of drapery clip 10 changes the spacing between legs 18 and 26 to accommodate various sized peripheral edges of tables utilized with the present drapery clip 10. Engagement of end 22*b* of curvilinear portion 22 with slide member 24 maintains slide member 24 in the desired position to thereby urge leg 26 against the underside surface of a table, to be subsequently described with respect to FIGS. 4 and 5.

In order to withdraw and engage curvilinear portion 22 with slide member 24, curvilinear portion 22 of leg 20 includes a tab 30. By grasping tab 30, end 22*b* of curvilinear portion 22 can be removed from a slot 28 of slide member 24.

Figure 7:
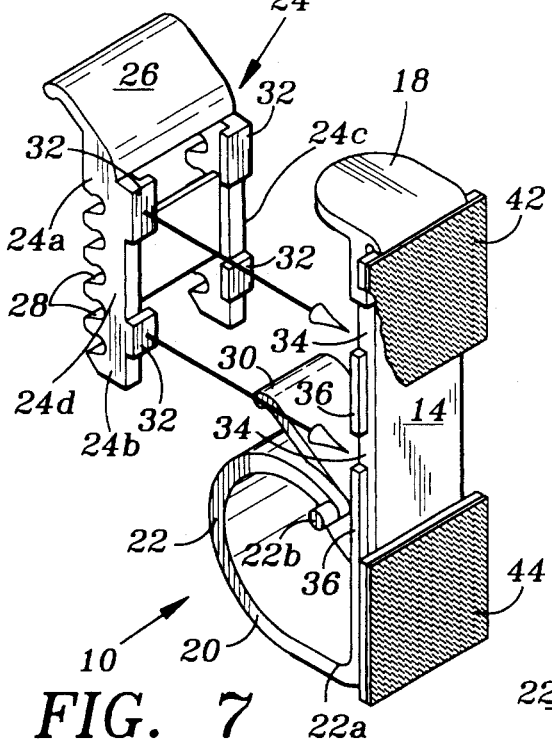
FIG. 7 is an exploded perspective view of the slide of the present drapery clip.
Figure 5:
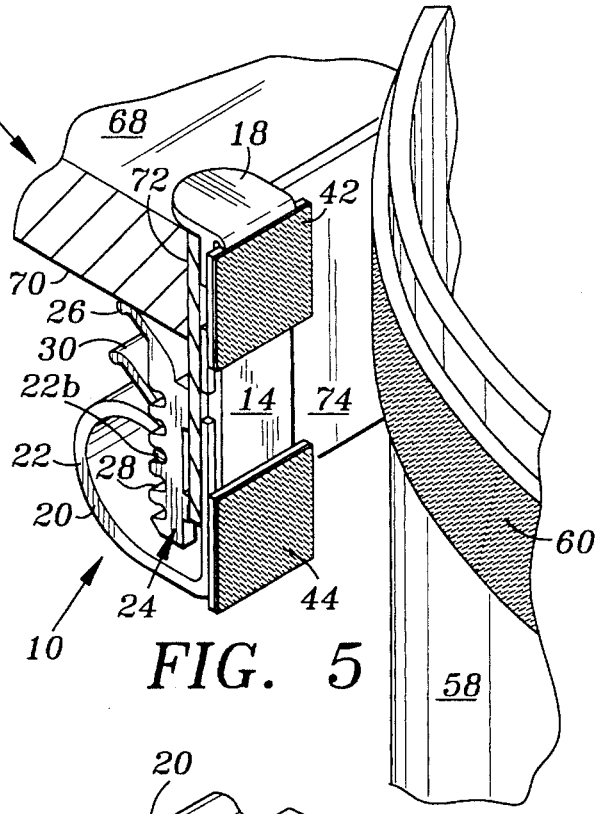
FIG. 5 is a perspective view of a portion of a table having a downwardly extending flange around the periphery thereof, illustrating the use of the present drapery clip.

As more clearly shown in FIG. 7, slide member 24 includes tabs 32 which are received in slots 34 within face portion 12 of clip 10. Slide member 24 slides along runners 36 contained within the edges of face portion 12. Slide member 24 can be removed from runners 36 of face portion 12 of clip 10 and attached to end 22*b* of curvilinear portion 22 via slot 28 as shown in FIG. 5 to accommodate a table having a downwardly extending flange to be subsequently described with respect to FIG. 5.

Referring again to FIGS. 1, 2, and 3, extending from ends 12*a* and 12*b* of face portion 12 are extension members 38 and 40, respectively. Extension members 36 and 40 are generally parallel to front surface 14 of face portion 12 and are spaced apart therefrom. This spacing allows clip 10 to be placed over an existing hanging drape for hanging a valance adjacent to another drape. Disposed on extension members 38 and 40 are fasteners 42 and 44, respectively, such as, for example, Velcro fabric which is a pile fabric having the pile loops split or cut. Fasteners 42 and 44 mate with a fastener, such as for example, a piece of Velcro fabric having pile loops which are not split which is attached to the inner surface of a drape as will be discussed in connection with FIGS. 4, 5, and 6.

Drapery clip 10 is made from a resilient material such as, for example, thermoplastic material that can be injection molded. A preferred plastic may include, for example, polycarbonate, polystyrene, ABS or the like, and may include Lexan material. The material used must have sufficient resilience, strength and flexibility to allow drapery clip 10 to be resiliently received by the structure to which it is attached.

Figure 4:
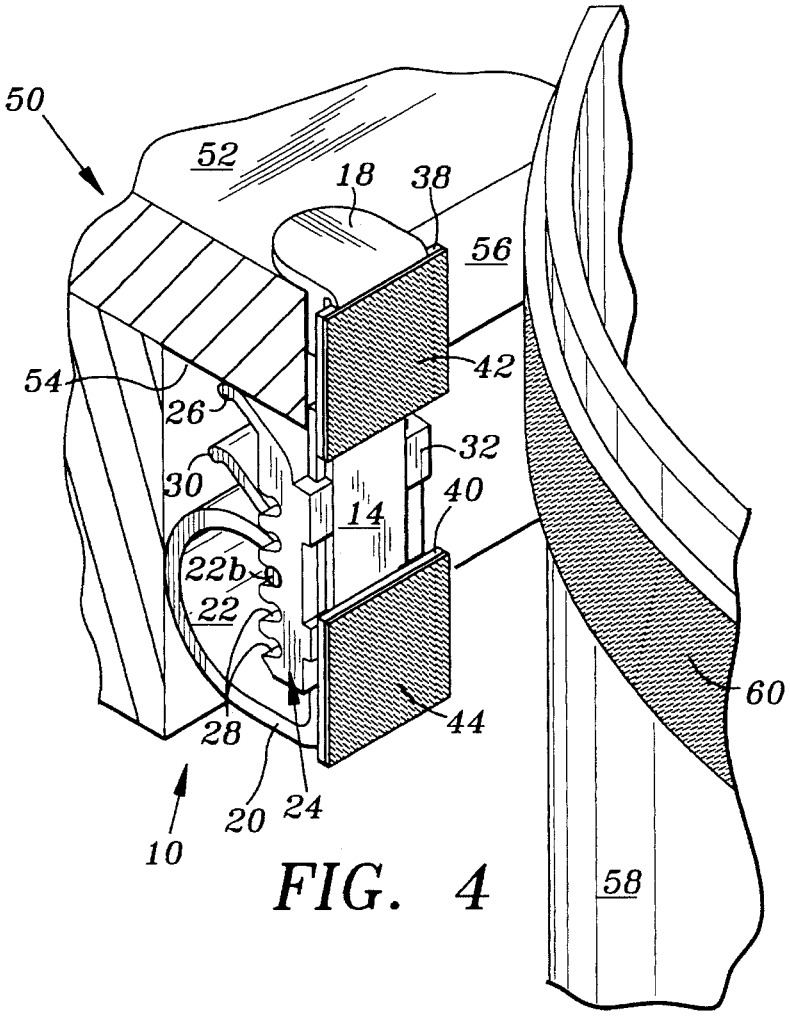
FIG. 4 is a perspective view of a portion of a table illustrating the use of the present drapery clip.

Referring now to FIG. 4, one use of the present drapery clip 10 for use in skirting a table will now be discussed. FIG. 4 illustrates a table 50 having a top surface 52, an underside surface 54, and a peripheral edge 56. Drapery clip 10 is positioned on table 50 such that the inner surface of leg 18 contacts top surface 52 of table 50, and the inner surface of leg 26 contacts underside surface 54 of table 50. Back surface 16 of face portion 12 lies adjacent to peripheral edge 56. The location of end 22*b* of curvilinear portion 22 with respect to slot 28 of slide member 24 is based upon the thickness of edge 56.

Table 50 may be draped or skirted utilizing a drape 58 which includes a fastener 60 such as, for example, Velcro fabric having pile loops which are not split. Fastener 60 mates with fastener 42 on extension member 38 of clip 10. Any number of clips 10 may be used to fasten drape 58 to table 50. Clips 10 frictionally engage table 50 along peripheral edge 56 and can be moved by applying sufficient horizontal force to overcome this frictional engagement. It is not necessary to accurately position clips 10 along peripheral edge 56 as fastener 60 extends along the entire length of drape 58, such that drape 58 can be easily mated with fastener 42 of several clips 10 positioned along peripheral edge 56.

Referring now to FIG. 5, clip 10 can also be utilized for fastening a drape to a table having a downwardly extending flange. FIG. 5 illustrates a table 66 having a top surface 68, an underside surface 70, and a peripheral edge 72. A downwardly extending flange member 74 extends from peripheral edge 72. Clip 10 is mounted to table 66 such that the inner surface of leg 18 engages top surface 68 of table 66. Downwardly extending flange member 74 is resiliently and frictionally engaged between slide member 24 and back surface 16 of face portion 12 of clip 10. The springlike action of curvilinear portion 22 of clip 10 results in the frictional engagement of slide member 24 with downwardly extending flange member 74 to ensure engagement of clip 10 with table 66. Drape 58 is attached to clip 10 in a manner as described with respect to the use of clip 10 and table 50 (FIG. 4).

Figure 6:
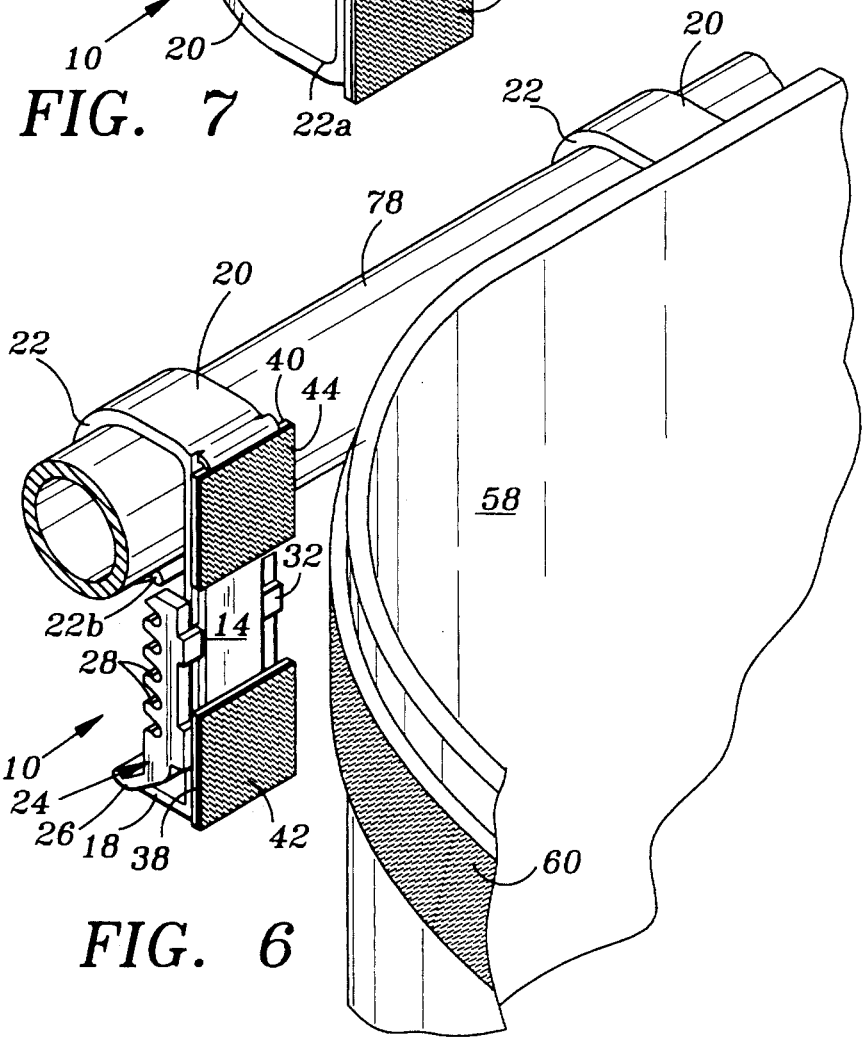
FIG. 6 is a perspective view of a drapery rod illustrating use of the present drapery clip.

An additional use of clip 10 is for mounting a drape 58 to a drapery rod. Referring now to FIG. 6, clip 10 may be utilized for mounting drape 58 to a drapery rod 78 by snapping curvilinear portion 22 around rod 78. Although rod 78 is illustrated as having a cylindrical configuration, rod 78 may also have a square configuration. Drape 58 is attached to clip 10 via fastener 60 which mates with fastener 44 on extension member 40. In the event that rod 78 has an area smaller than the diameter of curvilinear portion 22 of clip 10, clip 10 may be locked to rod 78 by inserting end 22*b* into a slot 28 of slide member 24, thereby locking clip 10 to rod 78.

It therefore can be seen that the present clip provides for the attachment of a drape to multiple types of structures, for example, tables, tables having flange members, as well as drapery rods. The present clip combines the function of numerous individual clips into a single universal clip for mounting a drape to a variety of structures. The present clip is easy to install and maintain. Although fasteners 42,44, and 60 have been illustrated as being Velcro material, it is understood that any type of mechanical fasteners such as, for example, snaps, can be utilized with clip 10.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A clip for alternatively draping one of two structures, the first structure having a top surface, an underside surface, and a peripheral edge; the second structure having a rod support member, the clip comprising:

a face portion having front and back surfaces and first and second ends, such that said back surface of said face portion contacts the peripheral edge of the first structure;

a first leg perpendicularly disposed to and extending rearwardly from said back surface at said first end of said face portion, such that said first leg contacts the top surface of the first structure;

a slide member disposed adjacent said back surface of said face portion and movable between said first and second ends of said face portion;

said slide member including a linear portion for engaging the underside surface of the first structure of various sized peripheral edges of the first structure;

said slide member further including a plurality of fasteners;

a second leg having a curvilinear portion;

said curvilinear portion of said second leg extending rearwardly from said back surface at said second end of said face portion for engaging the rod support member of the second structure, said curvilinear portion having first and second ends, said first end connected to said back surface of said second end of said face portion and said second end being spaced apart from said back surface of said face portion;

said second end of said curvilinear portion being selectively received by one of said plurality of fasteners on said slide member for selectively connecting said second leg to said slide member; and fastener means attached to said face portion for detachably mating with fasteners on the drape.

2. The clip of claim 1 wherein said slide member is removably mounted to said face portion.

3. The clip of claim 1 wherein said fastener means attached to said face portion are attached to said first and second ends of said face portion.

4. The clip of claim 1 wherein said fastener means attached to said face portion are attached to said first and second ends of said face portion and are spaced apart from said front surface of said face portion.

5. The clip of claim 1 wherein said slide member plurality of fasteners include slots extending transverse to said slide member.

6. The clip of claim 1 wherein movement of said slide member is prevented when said second end of said curvilinear portion engages one of said plurality of fasteners on said slide member.

7. A clip for alternatively draping one of three structures, the first structure having a top surface, an underside surface, and a peripheral edge; the second structure having a top surface, and a peripheral edge having a downwardly extending flange member; and the third structure having a rod support member, the clip comprising:

a face portion having front and back surfaces and first and second ends, such that said back surface of said face portion contacts the peripheral edge of the first structure or the downwardly extending flange member of the second structure;

a first leg perpendicularly disposed to and extending rearwardly from said back surface at said first end of said face portion, such that said first leg contacts the top surface of the first or second structure;

a slide member disposed adjacent said back surface of said face portion and movable between said first and second ends of said face portion and being selectively detachable from said face portion;

said slide member including a linear portion for engaging the underside surface of the first structure of various sized peripheral edges of the first structure when attached to said face portion or various sized flange members of the second structure when detached from said face portion; the flange member being disposed between said slide member and said back surface of said face portion;

said slide member further including a plurality of fasteners;

a second leg having a curvilinear portion;

said curvilinear portion of said second leg extending rearwardly from said back surface at said second end of said face portion for engaging the rod support member of the third structure, said curvilinear portion having first and second ends, said first end connected to said back surface of said second end of said second end of said face portion and said second end being spaced apart from said back surface of said face portion;

said second end of said curvilinear portion being selectively received by one of said plurality of fasteners on said slide member for selectively connecting said second leg to said slide member; and fastener means attached to said face portion for detachably mating with fasteners on the drape.

8. The clip of claim 7 wherein said slide member is removably mounted to said face portion.

9. The clip of claim 7 wherein said fastener means attached to said face portion are attached to said first and second ends of said face portion.

10. The clip of claim 7 wherein said fastener means attached to said face portion are attached to said first and second ends of said face portion and are spaced apart from said front surface of said face portion.

11. The clip of claim 7 wherein said slide member plurality of fasteners include slots extending transverse to said slide member.

12. The clip of claim 7 wherein movement of said slide member is prevented when said second end of said curvilinear portion engages one of said plurality of fasteners on said slide member.

* * * * *